US005522467A

United States Patent [19]

Stevens et al.

[11] Patent Number: 5,522,467

[45] Date of Patent: Jun. 4, 1996

[54] SYSTEM AND STABILIZER APPARATUS FOR INHIBITING HELICAL STACK-OUT

[75] Inventors: Joseph C. Stevens, Traverse City; John G. Gordon, Fife Lake, both of Mich.

[73] Assignee: Great Lakes Directional Drilling, Fife Lake, Mich.

[21] Appl. No.: 444,531

[22] Filed: May 19, 1995

[51] Int. Cl.[6] ..... E21B 17/10

[52] U.S. Cl. ..... 175/73; 175/325.3; 175/325.5

[58] Field of Search ..... 175/61, 73, 325.1–325.4

[56] References Cited

U.S. PATENT DOCUMENTS

| | | | |
|---|---|---|---|
| 3,361,493 | 1/1968 | Melton | 308/4 |
| 3,971,450 | 7/1976 | Fox | 175/325.3 X |
| 4,013,325 | 3/1977 | Rear | 175/325.3 |
| 4,231,437 | 11/1980 | Swersky et al. | 175/325 |
| 4,384,626 | 5/1983 | Derouin | 175/325.4 X |
| 4,385,669 | 5/1983 | Knutsen | 175/325.4 X |
| 4,407,377 | 10/1983 | Russell | 175/325.2 |
| 4,467,879 | 8/1984 | Burge | 175/325.4 |
| 4,548,284 | 10/1985 | Shinn et al. | 175/325.4 X |
| 4,561,508 | 12/1985 | Garrett | 175/347 |
| 4,776,410 | 10/1988 | Perkin et al. | 175/325 |
| 4,848,490 | 7/1989 | Anderson | 175/325.4 X |
| 4,958,692 | 9/1990 | Anderson | 175/323 |
| 5,033,558 | 7/1991 | Russo et al. | 175/325 |
| 5,358,042 | 10/1994 | Stoltz | 166/241.6 |

OTHER PUBLICATIONS

"Blast Hole Roller–Stabilizer", Permian Reamer Mfg., Inc., Product Catalogue, (undated).

*Primary Examiner*—Roger J. Schoeppel
*Attorney, Agent, or Firm*—Brooks & Kushman

[57] ABSTRACT

A connector for drill string elements is formed as a cylindrical body having a bore and threaded sections on opposite ends for connecting drill tubing or pipes together. A plurality of bearings are secured at spaced points to the exterior of the cylindrical body. One or more slots are formed in the exterior of the body to allow fluid to pass in a return flow. Also disclosed is a helical stack-out inhibiting system for horizontal drilling operations utilizing a plurality of tubular members having an outer diameter that is slightly less than the inner diameter of the hole being drilled. A plurality of rolling bearing members are secured to and extend outboard of the exterior surface of each tubular member. The rolling bearing members facilitate the axial and rotational movement of the drill string in horizontal drilling operations and also inhibit the drill pipe or tubing from contacting the sides of the hole.

22 Claims, 5 Drawing Sheets

Fig-1
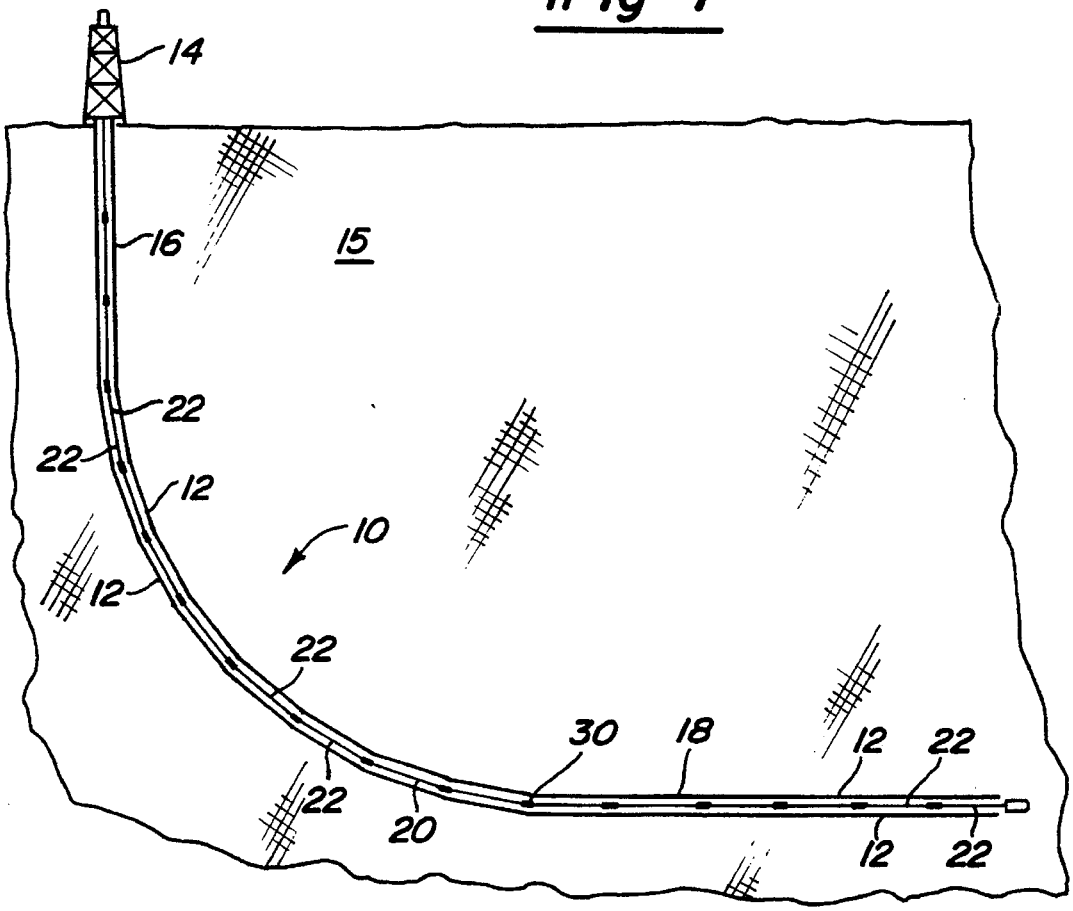
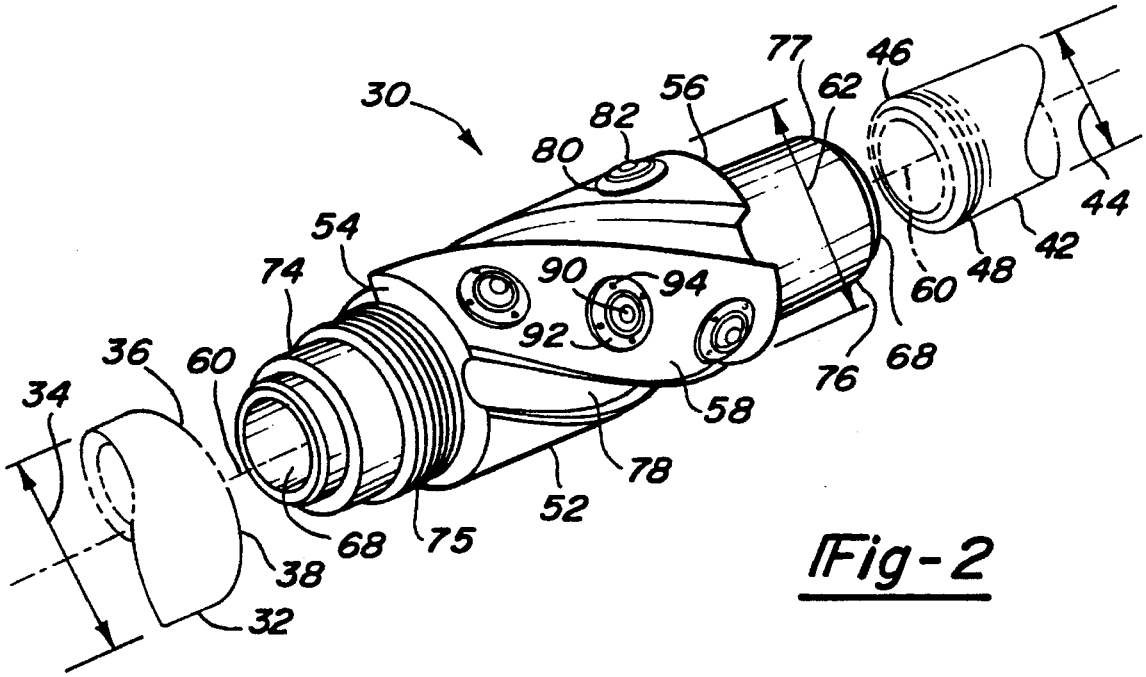
Fig-2

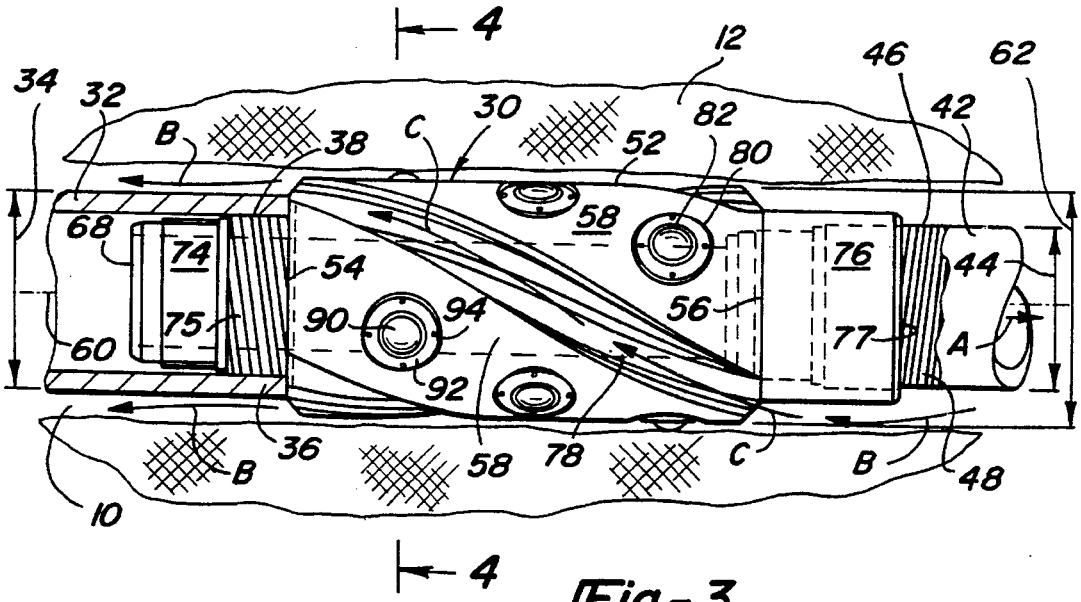
Fig-3
Fig-5
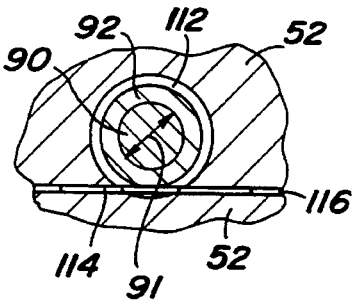
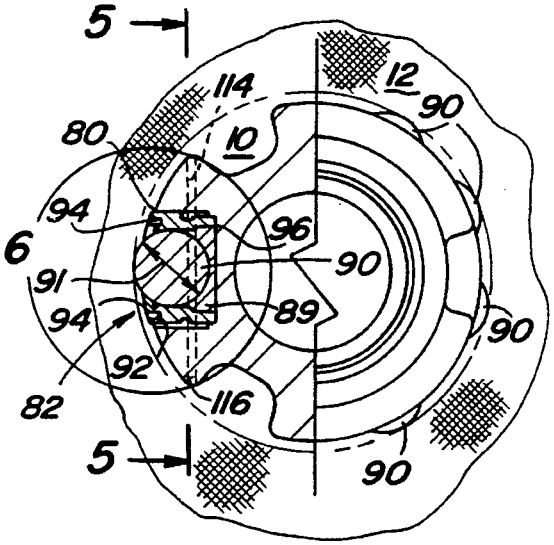
Fig-4

Fig-8
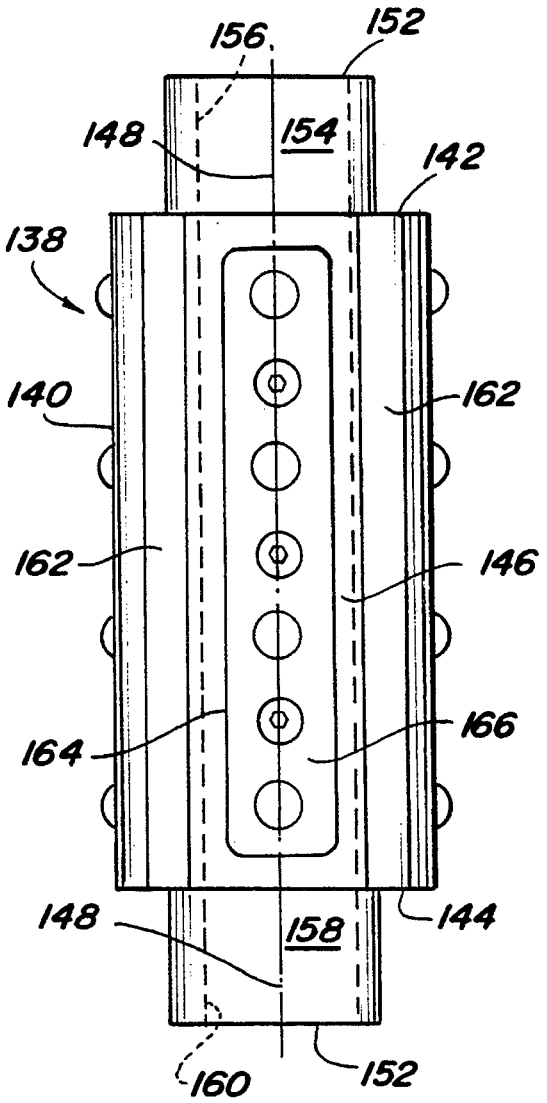
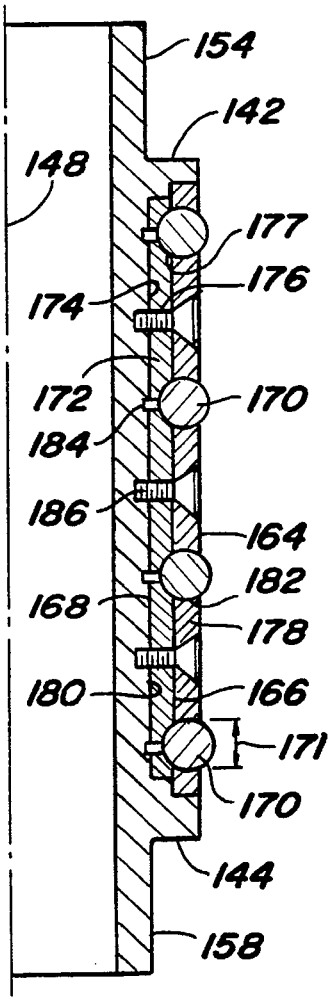
Fig-9
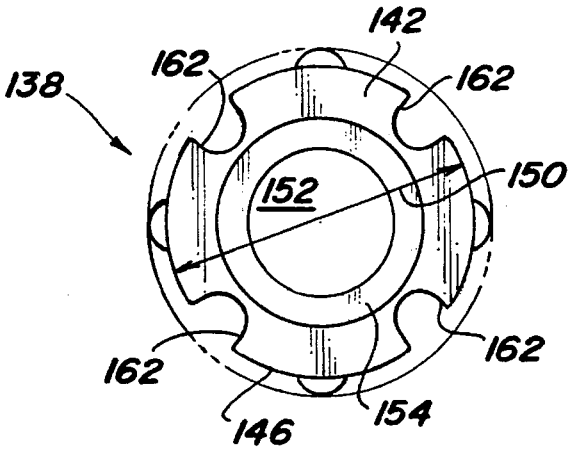
Fig-10

Fig-11
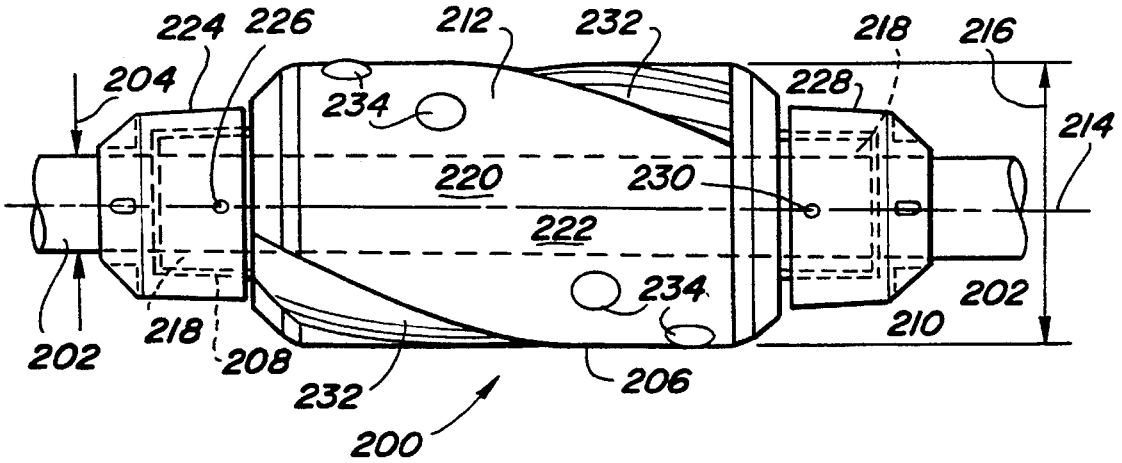
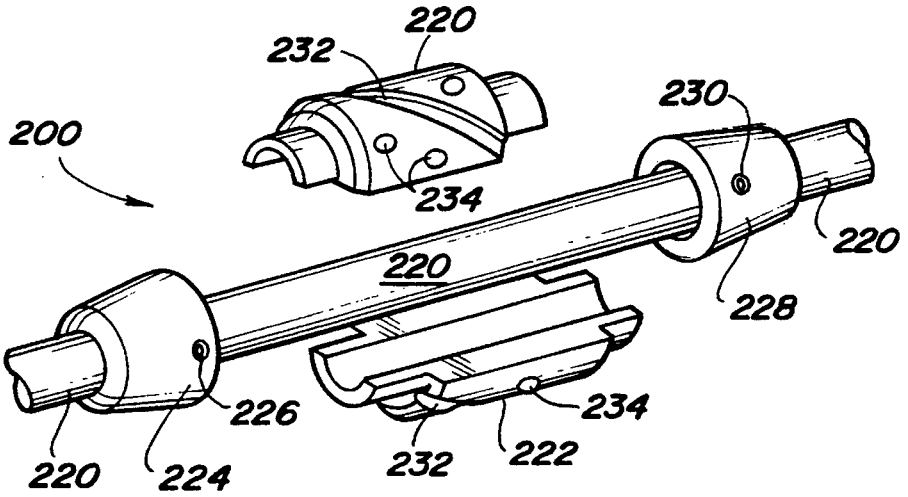
Fig-12

SYSTEM AND STABILIZER APPARATUS FOR INHIBITING HELICAL STACK-OUT

TECHNICAL FIELD

This invention relates to drill string connectors having rolling bearings which facilitate axial and rotational movement of the drill string in a horizontal drilling operation, and to a horizontal drilling system for reducing torque and drag coefficients and reducing the tendency of a drill string to helically stack-out.

BACKGROUND ART

Oil and gas drilling processes have been developed wherein the bore hole initially is vertical and then turns to a horizontal orientation. Utilizing prior art techniques, for example, a down-hole of about 5,000 foot depth may be formed and then a horizontal hole can be formed starting at a down-hole location that can extend, depending upon various subterranean factors, from 500 to 800 feet horizontally. One problem with prior art drill strings is frictional drag. Another problem is helical stack-out. Helical stack-out is defined as the tendency of the drill string to distort into a helical configuration within the horizontal section of the bore hole causing a loss of drill weight, or pressure, after the horizontal bore hole extends 500 or so feet.

Connectors between drill strings are generally simple structures allowing for threaded connection to adjacent sections of drill pipe or tubing.

Centralizers, such as that shown in U.S. Pat. No. 5,358,042, issued to Stoltz, have been developed for use in cased holes. The centralizers disclosed in this patent include spherical roller elements mounted on centralizer support arms that extend radially outward of the drill string. Rollers extend radially outward to a point at which the rollers engage the inner surface of the casing. This apparatus is intended for finalizing installation of equipment in a bore hole and not for a primary drilling operation.

Also known in the industry are down-hole stabilizers such as that disclosed in U.S. Pat. No. 4,958,692, issued to Anderson. The stabilizer disclosed in the Anderson patent is a reamer which is intended to be mounted adjacent the drill bit. The stabilizer includes a plurality of rolling bearings individually mounted in pockets on the periphery of the stabilizer. The stabilizer also includes helically disposed fins or blades that function as a cutter in addition to functioning as a reamer. Only one such device is intended to be used in a drill string and it does not solve the problem of helical stack-out or minimize frictional drag along the length of the drill string. Due to the high cost of reamers, it is unfeasible to use a series of reamers between lengths of a drill string.

A substantial increase in oil production can be achieved if the length of horizontal drilling is extended to reach additional deposits of oil from a down-hole bore. Such a result is not possible with prior art drilling equipment.

Another problem is the need to remove drill cuttings from the bore hole. Fluid is pumped down through the drill string to the drill bit. Drill cuttings are removed by the backflow of drilling fluid between the outer wall of the drill string and the inner diameter of the bore hole. Pump sweeps are performed wherein a thickened suspension is pumped through the bore hole to suspend cuttings in a mud-like gel. While a certain amount of turbulence is present adjacent the drill bit, no prior art system is known that creates fluid turbulence at spaced intervals along the drill string for the purpose of enhancing removal of cuttings.

Prior art drilling equipment and techniques, when used in a horizontal bore hole, fail to provide the simple and effective solution summarized below.

For the foregoing reasons, there is a need for a drill string connector and system for inhibiting helical stack-out that overcomes the problems and limitations of the prior art.

DISCLOSURE OF THE INVENTION

One aspect of the present invention relates to providing a connector for a series of drill string elements in a horizontal drilling operation. The drill string elements may be drill tubes, drill pipe, or other equivalent elements. The connector facilitates the sliding and rotation of the drill string within a bore hole. This allows for substantial increase in range for horizontal drilling operations which start as a vertical bore hole and curve to a horizontal bore hole.

The connector comprises a cylindrical body portion having a bore through the body portion along a central axis of the body portion. Threaded sections are formed on opposite ends of the cylindrical body for connecting two drill string elements together. A plurality of bearings are secured to the exterior of the cylindrical body at spaced points about the perimeter of the body. At least one slot is formed in the exterior of the body and extends from one end of the cylindrical body to the other end. The slot is provided to permit a return flow of drilling fluid. The ability of the drilling fluid to carry drill cuttings is enhanced when turbulence is induced periodically along the return flow path of the drilling fluid. The more turbulent the flow, the more solid material can be carried in a reverse flow from the bore hole. Providing additional turbulence reduces the need to perform pump sweeps through the bore hole.

The bearings are preferably secured to the exterior of the body in a helical array extending from one end of the body to the other. The bearings are preferably ball bearings which are secured to the cylindrical body by means of bearing caps. The bearings are intended to be the contact points of the connector and drill string with the walls of the bore hole.

Preferably, the slots are helically generated to induce turbulence in the flow of fluid returning through the bore hole. Preferably, three slots are formed in the body at circumferentially spaced points each slot extending with the same helical arc. The three helical slots define three surfaces of the cylindrical body. On each surface, three ball bearings are secured at spaced axial locations in a helical alignment which corresponds to the helical arc of the slots.

Preferably, the threaded sections include one male and one female threaded section. However, the threaded sections may include two male threaded sections, or two female threaded sections instead.

According to another aspect of the invention, a helical stack-out inhibiting system for horizontal drilling operations is provided wherein walls defining a bore hole having a desired diameter are drilled in the ground. Tubular connectors are provided between each of drill string elements in the horizontally oriented portion of the bore hole. The connectors have an exterior surface with an outer diameter less than the diameter of the walls of the bore hole. The tubular connectors include a plurality of bearing members which are secured to the exterior surface to extend outboard of the exterior surface. First and second adapters are provided on axially opposite ends of each tubular connector. At least one outwardly open slot is formed in the exterior surface of the connector. A plurality of drill string elements having an outer diameter substantially less than the outer diameter of the connectors and having first and second mating adapters on opposite ends thereof is provided. The drill string elements are connected in series with a connecter between adjacent drill string elements. The bearing members facilitate sliding and rotation of the drill string in the horizontal drilling operation. The tubular connectors center the drill string elements within the hole at regular intervals and thereby reduce the tendency of drill string elements to contact the walls of the bore hole.

Helical stack-out is inhibited by reason of the close fit between the bearings and the walls of the bore hole. Instead of helically distorting the drill string, the drill string is permitted to slide and rotate within the bore hole on the bearing members.

The connectors are intended to permit increased horizontal penetration by reducing the frictional drag of the drill string as it is extended in the horizontal direction. Frictional drag is caused by the drill string lying upon the walls of the bore hole or helically stacking out. The bearing members support the drill string at each joint in the drill string so that the drill string elements, such as drill tubes or drill pipes, tend not to contact the walls of the bore hole.

According to the invention, fatigue on the drill string elements and connectors is reduced in comparison to prior art horizontal drilling devices. This increases the useful life of the drilling apparatus and decreases the chances of failure or rupture of the drill string. According to the invention, a horizontal drill string provided with the connectors of the present invention is believed to be capable of horizontal drill string lengths of 2,000 to 3,000 feet whereas the prior art techniques are limited to 500 to 800 feet. The increased horizontal penetration is possible because of the reduction in frictional drag. The present invention allows for more of the drilling pressure to be applied to the drilling tool.

According to an additional aspect of the present invention, a connector is provided for consecutive drill string elements in a series of drill string elements. The connector comprises a cylindrical body portion having first and second ends, an exterior surface, and a central axis. The connector has a bore through the cylindrical body portion along the central axis. First and second adapters extend outwardly from the first and second ends of the cylindrical body portion. The adapters are for receiving ends of first and second drill string elements.

At least one slot is formed in the exterior surface and extends from the first end to the second end of the cylindrical body portion. A plurality of bearings are secured to the cylindrical body portion at spaced locations about the exterior surface. Each bearing projects outboard of the exterior surface. The bearings facilitate the axial and rotational movement of the drill string elements within a bore hole. Further, the bearings reduce the tendency of the drill string elements to contact bore hole walls.

In one embodiment, elongated recesses are formed in the exterior surface of the cylindrical body portion and receive the bearings. Each bearing is a compound bearing assembly including at least one bearing ball, a compound bearing seat plate, and a compound bearing cap plate. The compound bearing seat plate has an inner surface engaging a bottom surface of the recess, and an outer surface having spherical seats for receiving the bearing balls. The compound bearing cap plate has an inner surface engaging the compound bearing seat, and a partial spherical opening for retaining the bearing balls. Fasteners secure the bearing seat and cap plates to the recesses. Each bearing ball projects outboard of the exterior surface of the cylindrical body portion.

In another embodiment, a plurality of pockets are formed in the exterior of the cylindrical body portion and receive the bearings therein. Each bearing is a bearing assembly including a bearing ball, a bearing seat, and a bearing cap. The bearing seat has an inner surface engaging a bottom surface of the pocket, and a partial spherical recessed portion engaging the bearing ball. The bearing cap has an inner surface engaging the bearing seat while retaining the bearing ball. An externally threaded section of the bearing cap engages with an internally threaded section of the pocket. An annular groove on the bearing cap is engagable by a pin. The pin extends through a hole in the cylindrical body portion to engage the annular groove and secure the bearing in the pocket. Each bearing ball projects outboard of the exterior surface of the cylindrical body.

Further in accordance with the present invention, a method and apparatus for inhibiting helical stack-out in a drilling operation utilizing a drill string is provided. The helical stack-out inhibiting apparatus comprises a cylindrical body portion encircling a section of the drill string. The cylindrical body portion has first and second ends, an exterior surface, a central axis, and a bore through the cylindrical body portion along the central axis. The cylindrical body portion is formed by first and second semi-cylindrical halves which include the first and second ends of the cylindrical body portion. The cylindrical halves are clamped together by first and second annular collars that encircle the drill string and engage the first and second ends. The annular collars clamp the ends of the cylindrical body portion together and lock the body portion to the drill string.

At least one slot is formed in the exterior surface and extends from the first end to the second end of the cylindrical body portion. A plurality of bearings are secured to the cylindrical body portion at spaced locations about the exterior surface. Each bearing projects outboard of the exterior surface and facilitates the axial and rotational movement of the drill string within a bore hole. Further, the bearings reduce the tendency of the drill string to contact bore hole walls. Preferably, the slots are helically generated and the bearings are situated along helical paths.

These and other advantages of the present invention will be better understood by those of ordinary skill in the art upon review of the attached drawings and the following detailed description of preferred embodiments of the invention.

BRIEF DESCRIPTION OF THE DRAWINGS

FIG. 1 is a side elevation, partially in section, of a drill string in a deviated well bore, adjacent drill string elements are coupled by connectors made in accordance with the present invention;

FIG. 2 is a perspective view of a connector made in accordance with the present invention;

FIG. 3 is a top plan view of a connector made in accordance with the present invention, in a horizontal well bore environment;

FIG. 4 is a partial cross-sectional view of the connector of the present invention taken along line 4—4 of FIG. 3;

FIG. 5 is a cross-sectional view of a bearing on the connector of the present invention taken along line 5—5 of FIG. 4;

FIG. 8 is a top plan view of a third embodiment of a connector made in accordance with the present invention;

FIG. 9 is cross-sectional view taken along line 9—9 of FIG. 8;

FIG. 10 is an end elevation of the connector of FIG. 8;

FIG. 11 is a perspective view of a helical stack-out inhibiting apparatus made in accordance with the present invention; and FIG. 12 is an exploded perspective view of the helical stack-out inhibiting apparatus of FIG. 11.

BEST MODES FOR CARRYING OUT THE INVENTION

Figure 6:
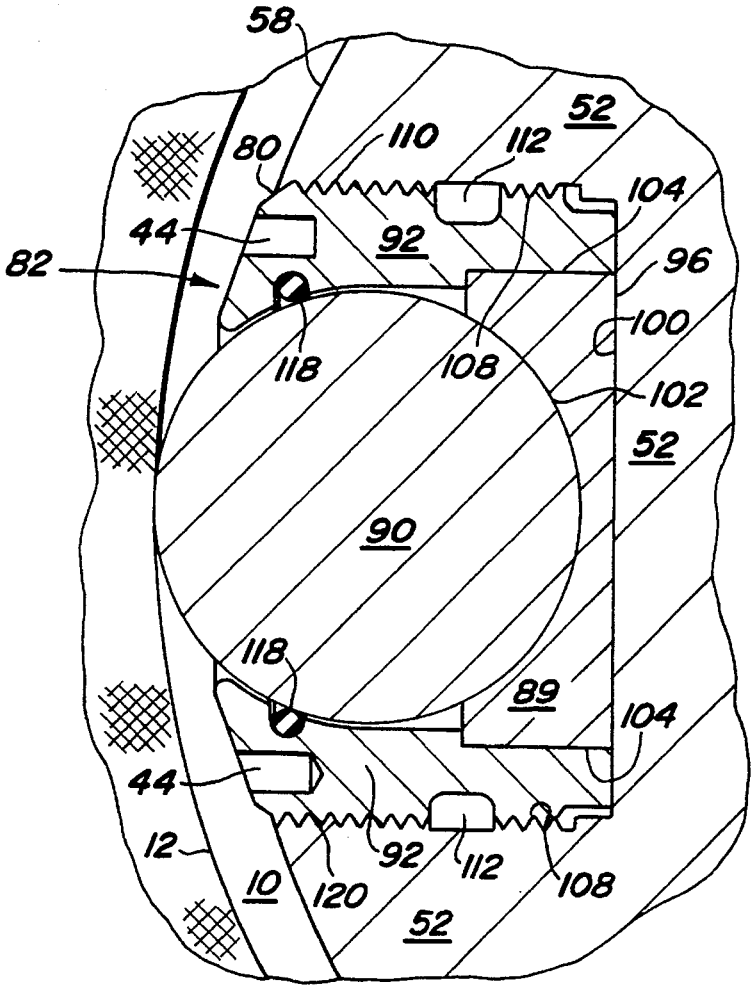
FIG. 6 is an enlarged cross-sectional view of the bearing on the connector shown in FIG. 4.

Referring now to FIG. 1, a bore hole 10 is illustrated that is defined by walls 12. The bore hole 10 has a vertical portion 16 and a horizontal portion 18 in the earth 15. From a drilling apparatus 14, a drill string 20 extends through the bore hole 10. The drill string 20 is formed by a plurality of drill string elements 22. A plurality of connectors 30 are located between adjacent drill string elements 22.

Referring to FIG. 2, each connector 30 has a cylindrical body portion 52 with first and second ends 54 and 56. The cylindrical body portion 52 has an exterior surface 58, a central axis 60, and an outside diameter 62. A bore 68 extends through the cylindrical body portion 52 along the central axis 60. First and second adapters 74 and 76 extend outwardly from the first and second ends 54 and 56 of the cylindrical body portion 52. The first and second adapters 74 and 76 receive first and second drill string elements 32 and 42, respectively. Adapters 74 and 76 have threaded portions 75 and 77 that mate with threaded portions 38 and 48 on the ends 36 and 46 of drill string elements 32 and 42.

At least one slot 78 extends from the first end 54 to the second end 56 of the cylindrical body portion 52. Preferably, the slots 78 are helically generated. Bearings, such as bearing assembly 82, are secured to the cylindrical body portion 52 between the first and second ends 54 and 56. The bearing assemblies 82 contact the bore hole walls thereby reducing torque and drag coefficients, and facilitating the axial and rotational movement of the drill string elements 22 within the bore hole 10. Preferably, the bearings are placed at spaced locations about the exterior surface 58 along a helical path.

Referring to FIGS. 2–5, the connector 30 is shown in the well bore environment and details of the bearing assemblies are shown. Each bearing assembly 82 includes a bearing seat 89, a bearing ball 90, and a bearing cap 92. Each bearing assembly 82 is disposed within a pocket 80 formed in the cylindrical body portion 52. The bearing balls 90 are retained by the bearing caps 92 and project sufficiently outboard of the exterior surface 58 of the cylindrical body portion 52 to extend beyond the outside diameters 34 and 44 of the first and second drill string elements 32 and 42. Each bearing cap 92 has openings 94 that are engaged by a wrench to turn the bearing assembly 82 into the respective pocket 80.

Flow arrow A indicates fluid flow from the drilling apparatus 14 down the drill string to a drill bit. Flow arrows B indicate the reverse fluid flow form the drill bit along the bore hole walls 12 carrying drill cuttings out of the bore hole 10. Flow arrow C indicates fluid flow through the helical slot 78, the helical slot 78 induces turbulence into the fluid flow. This turbulence promotes and facilitates the carrying of debris away from the bit.

Referring more specifically to FIGS. 4 and 5, bearing assembly 82 is shown disposed in the pocket 80 engaging a pocket bottom surface 96. Bearing seat 89 has an inner surface 100 that engages the pocket bottom surface 96. Bearing seat 89 also has a partial spherical recessed portion 102 that engages the bearing ball 90. Bearing cap 92 has an inner surface 104 that engages the bearing seat 98. Bearing cap 92 retains the bearing ball 90 on bearing seat 89. Bearing ball 90 is sized to project outboard of the exterior surface 58 of the cylindrical body portion 52 and into contact with the bore hole walls 12 and facilitate axial and rotational movement of the drill string.

Cylindrical body portion 52 has a hole 116 for receiving a pin 114. The bearing cap 92 has an annular groove 112 which receives the pin 114 to lock the bearing cap 92 into the hole 116.

With reference to FIG. 6, bearing assembly 82 is shown in greater detail. Bearing cap 92 has external threads 108. Pocket 80 has internal threads 110 for engaging external threads 108 on the bearing cap 92. Bearing cap 92 has openings 94 that are engaged by a wrench for turning the bearing assembly 82 into the pocket 80. Bearing cap 92 further has an O-ring 118 disposed between the bearing cap 92 and the bearing ball 90 which acts as a seal for inhibiting contamination of the bearing.

Figure 7:
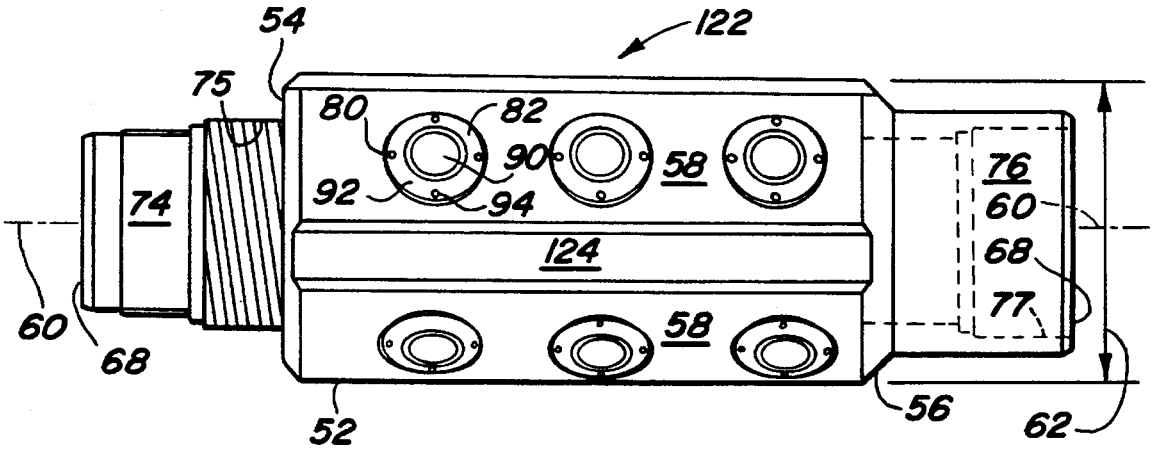
FIG. 7 is a top plan view of a second embodiment of a connector made in accordance with the present invention.

Referring now to FIG. 7, a second embodiment of a connector 122 is shown. The connector 122 has a linear slot 124. Bearing assemblies 82 are placed at spaced locations on the exterior surface 58 along a plurality of radially spaced linear paths.

With reference now to FIGS. 8–10, a third embodiment of a connector 138 is shown. The connector 138 has a cylindrical body portion 140 having first and second ends 142 and 144, an exterior surface 146, a central axis 148, and an outside diameter 150. A bore 152 extends through the cylindrical body portion 140. First and second adapters 154 and 158 are located at the first and second ends 142 and 144 of the cylindrical body portion 140, respectively. First and second adapters 154 and 158 may have threaded portions 156 and 160 which are adapted to be coupled to drill string elements. The cylindrical body portion 140 has at least one slot 162 to accommodate return fluid flow through the bore hole 10.

The cylindrical body portion 140 has a plurality of elongated recesses 166. Each recess 166 receives a compound bearing assembly 164 therein. Each compound bearing assembly 164 has at least one spherical bearing ball 170. The compound bearing assembly 164 has a compound bearing seat plate 172 with an inner surface 174 engaging a bottom surface 168 of the recess 166. The compound bearing seat plate 172 further has an outer surface 176 having at least one spherical recess portion 177 for engaging a bearing ball 170. The compound bearing cap plate 178 has an inner surface 180 which is abutted to the outer surface 176 of the compound bearing seat plate 172. Compound bearing seat plate 172 is fastened to the cylindrical body portion 140 by fasteners 184. Compound bearing cap plate 178 is fastened to the compound bearing seat plate 172 by fasteners 186. Bearing balls 170 have sufficient diameter 171 to project outboard of the exterior surface 146 of the cylindrical body portion 140.

With reference to FIGS. 11 and 12, a helical stack-out inhibiting apparatus 200 for use with continuous drill tubing and made in accordance with the present invention is shown.

A cylindrical body portion 206 encircles a drill string element 202, such as a drill tube, having an outside diameter 204. The cylindrical body portion 206 has first and second ends 208 and 210, an exterior surface 212, a central axis 214, and an outside diameter 216. A longitudinal bore 218 extends through the cylindrical body portion 206 along the central axis 214. The cylindrical body portion 206 is formed by first and second semi-cylindrical halves 220 and 222.

First and second annular collars 224 and 228 encircle the drill string element 202 and receive the first and second ends 208 and 210 of the cylindrical body portion 206. First and second semi-cylindrical halves 220 and 222 are clamped together by the first and second annular collars 224 and 228. The first and second annular collars 224 and 228 are secured to the first and second ends 208 and 210 of the cylindrical body portion 206 by fasteners 226 and 230. When used on continuous drill tubing, a suitable number of collar pairs 224 and 228 are placed on the tubing initially and secured to each apparatus 200 as they are assembled on the drill tubing.

At least one slot 232 is formed in the exterior surface 212 of the cylindrical body portion 206 to accommodate reverse fluid flow. Preferably, the slot 232 is helically generated.

A plurality of bearings 234 are secured to the exterior surface 212. Each bearing 234 extends outboard of the exterior surface 212 and beyond the outside diameter 204 of the drill string element 202 to contact the walls of a hole being drilled. By contacting the bore hole walls, bearings 234 facilitate axial and rotational movement of the drill string elements 202 within the bore hole, and reduce torque and drag coefficients. Preferably, the bearings 234 are placed at spaced locations about the exterior surface 212 and are situated along a helical path.

It should be appreciated that the present invention provides a drill string connector and system for inhibiting helical stack out by facilitating the axial and rotational movement of the drill string within the bore hole. Further, by providing slots for fluid flow, drill cuttings may be removed from the bore hole. The slots provide regularly spaced turbulence induction along the return flow path of the drilling fluid and thereby enhance the ability of the drilling fluid to carry drill cuttings.

It is to be understood, of course, that while the forms of the invention described above constitute the preferred embodiments of the invention, the preceding description is not intended to illustrate all possible forms thereof. It is also to be understood that the words used are words of description, rather than limitation, and that various changes may be made without departing from the spirit and scope of the invention, which should be construed according to the following claims.

What is claimed is:

1. A connector for a series of drill string elements, the connector comprising:

a cylindrical body portion having a bore through the cylindrical body portion along a central axis of the cylindrical body portion;

threaded sections on opposite ends of the cylindrical body portion for connecting two drill string elements together;

a plurality of bearings secured to the exterior of the cylindrical body portion at spaced points about the perimeter of the cylindrical body portion;

at least one slot formed in the exterior of the cylindrical body portion extending from one end of the cylindrical body portion to the other end.

2. The connector of claim 1 wherein said at least one slot is a helically generated slot.

3. The connector of claim 1 wherein said bearings are secured to the exterior of the body in a helical array extending from one end of the body to the other end.

4. The connector of claim 1 wherein said threaded sections include one male and one female threaded section.

5. The connector of claim 1 wherein said bearings are ball bearings secured to the body by bearing caps.

6. The connector of claim 1 wherein said bearings are the sole intended contact points with the walls of a bore hole.

7. The connector of claim 1 wherein three slots are formed in the body at circumferentially spaced points with each slot extending with the same helical arc and wherein three ball bearings are secured between each slot at spaced axial locations along the same helical arc as the slots.

8. A helical stack-out inhibiting system for horizontal drilling operations wherein walls defining a bore hole having a desired diameter are drilled into the ground, the system comprising:

a plurality of tubular connectors, each having an outer diameter which is less than the diameter of the walls of the bore hole being drilled, an exterior surface, a plurality of bearing members secured to the connectors and extending outboard of the exterior surface, first and second adapters on axially opposite ends of each tubular connector, and at least one outwardly open slot formed in the exterior surface thereof;

a plurality of drill string elements having an outer diameter less than the outer diameter of the connectors and having first and second mating adapters on opposite ends thereof, said drill string elements being connected in series with a connector between adjacent drill string elements, whereby the bearing members facilitate sliding and rotation of the drill string in the horizontal drilling operation and the tubular connectors center the drill string elements within the bore hole at regular intervals and thereby reduce the tendency of the drill string elements to contact the walls of the bore hole.

9. The helical stack-out inhibiting system of claim 8 wherein said at least one outwardly open slot is a helically generated slot.

10. The helical stack-out inhibiting system of claim 8 wherein said bearing members are secured to the exterior of the body in a helical array extending from one end of the body to the other.

11. The helical stack-out inhibiting system of claim 8 wherein said first and second adapters include one male and one female threaded section.

12. The helical stack-out inhibiting system of claim 8 wherein said bearing members are ball bearings secured to the tubular connector by bearing caps.

13. The helical stack-out inhibiting system of claim 8 wherein said bearing members are the intended contact points with the walls of the bore hole.

14. The helical stack-out inhibiting system of claim 8 wherein said drill string elements are drill pipe.

15. The helical stack-out inhibiting system of claim 8 wherein said drill string elements are drill tube.

16. The helical stack-out inhibiting system of claim 8 wherein three slots are formed in each tubular connector at circumferentially spaced points with each slot extending with the same helical arc and wherein said bearing members include three ball bearings secured between each slot at spaced axial locations along the same helical arc as the slots.

17. A connector for consecutive drill string elements in a series of drill string elements, the connector comprising:

a cylindrical body portion having first and second ends, an exterior surface, a central axis, and a bore through said cylindrical body portion along the central axis;

a first adapter extending outwardly from the first end of said cylindrical body portion for receiving an end of a first drill string element;

a second adapter extending outwardly from the second end of said cylindrical body portion for receiving an end of a second drill string element;

at least one slot formed in the exterior surface and extending from the first end to the second end of said cylindrical body portion; and a plurality of bearings secured to said cylindrical body portion at spaced locations about the exterior surface, each bearing projecting outboard of the exterior surface and thereby facilitating the axial and rotational movement of the drill string elements within a bore hole and reducing the tendency of the drill string elements to contact bore hole walls.

18. The connector of claim 17 wherein said at least one slot is helically generated, and wherein the spaced locations about the exterior surface are situated along at least one helical path extending from the first end to the second end of said cylindrical body portion.

19. The connector of claim 17 wherein at least one elongated recess is formed in the exterior surface of the cylindrical body portion and each recess receives one of said bearings therein, and wherein each of said bearings is a compound bearing assembly including:

at least one bearing ball;

a compound bearing seat plate having an inner surface engaging a bottom surface of the recess, and an outer surface having at least one partial spherical recess portion for engaging a bearing ball;

a compound bearing cap plate having an inner surface engaging said compound bearing seat plate and retaining said at least one bearing ball between said compound bearing seat plate and said compound bearing cap plate; and at least one fastener securing said compound bearing assembly to the recess, said at least one bearing ball projecting outboard of the exterior surface of said cylindrical body portion.

20. The connector of claim 17 wherein a plurality of pockets are formed in the exterior surface of the cylindrical body portion and each pocket receives one of said bearings therein, and wherein each of said bearings is a bearing assembly including:

a bearing ball;

a bearing seat having an inner surface engaging a bottom surface of the pocket, and a partial spherical recess portion engaging said bearing ball; and a bearing cap having an inner surface engaging said bearing seat and retaining said bearing ball between said bearing seat and said bearing cap, an externally threaded section engaging with an internally threaded section of the pocket, and an annular groove adapted to be engaged by a pin, said pin extending through a hole in said cylindrical body portion to engage said annular groove thereby securing said bearing in the pocket, said bearing ball projecting outboard of the exterior surface of said cylindrical body.

21. An apparatus for inhibiting helical stack-out in a drilling operation utilizing a drill string, the apparatus comprising:

a cylindrical body portion encircling the drill string and having first and second ends, an exterior surface, a central axis, and a bore through said cylindrical body portion along the central axis, said cylindrical body portion being formed by first and second semi-cylindrical halves;

a first annular collar encircling the drill string and receiving the first end of said cylindrical body portion to clamp the first and second semi-cylindrical halves together;

a first fastener securing said first annular collar to the first end of said cylindrical body portion;

a second annular collar encircling the drill string and receiving the second end of said cylindrical body portion to clamp the first and second semi-cylindrical halves together;

a second fastener securing said second annular collar to the second end of said cylindrical body portion;

at least one slot formed in the exterior surface and extending from the first end to the second end of said cylindrical body portion; and a plurality of bearings secured to said cylindrical body portion at spaced locations about the exterior surface, each bearing projecting outboard of the exterior surface and thereby facilitating the axial and rotational movement of the drill string within a bore hole and reducing the tendency of the drill string to contact bore hole walls.

22. The connector of claim 21 wherein said at least one slot is helically generated, and wherein the spaced locations about the exterior surface are situated along at least one helical path extending from the first end to the second end of said cylindrical body portion.

* * * * *